US005142840A

United States Patent [19]

Cappi et al.

[11] Patent Number: 5,142,840

[45] Date of Patent: Sep. 1, 1992

[54] BAG OPENING DEVICE FOR AUTOMATICALLY OPENING PLASTIC BAGS IN SUPERMARKET CHECK-OUT COUNTERS INCORPORATING BAG DISPENSING MACHINES

[75] Inventors: Angelo Cappi, Vignola; Renato Rimondi, Bazzano, both of Italy

[73] Assignee: A.W.A.X. Progettazione E Ricerca S.r.l., Vignola, Italy

[21] Appl. No.: 736,395

[22] Filed: Jul. 26, 1991

[30] Foreign Application Priority Data

Aug. 1, 1990 [IT] Italy ..... 21170A/90

[51] Int. Cl.[5] ..... B65B 43/28

[52] U.S. Cl. ..... 53/384.1; 53/390; 53/570

[58] Field of Search ..... 53/384.1, 381.1, 390, 53/459, 468, 568, 567, 570, 385.1, 386.1

[56] References Cited

U.S. PATENT DOCUMENTS

| | | | |
|---|---|---|---|
| 3,740,922 | 6/1973 | Liou | 53/384.1 X |
| 3,859,062 | 1/1975 | Okubo et al. | 53/384.1 X |
| 4,085,822 | 4/1978 | Osborn | 53/385.1 X |
| 4,245,944 | 1/1981 | Van Ginkel et al. | 53/384.1 X |
| 4,835,948 | 6/1989 | Humphrey | 53/385.1 X |
| 4,874,354 | 10/1989 | Johnson et al. | 53/385.1 X |

FOREIGN PATENT DOCUMENTS

| | | |
|---|---|---|
| 1294669 | 4/1962 | France . |
| 87-02001 | 3/1989 | Netherlands . |

*Primary Examiner*—James F. Coan

*Attorney, Agent, or Firm*—Cohen, Pontani, Lieberman & Pavane

[57] ABSTRACT

Bag opening device for supermarket check-out counters incorporating bag dispensing machines, comprising a pair of pliers mounted on a pair of guides capable of a reciprocating horizontal motion. The pliers grasp and pull apart the two opposite sides of a bag fed by feeding belts. Each pliers (1, 2) consists of a pair of jaws (9, 9' and 11, 11') meshing with each other by means of a pair of toothed wheels (13, 13' and 14, 14') and pushed towards each other by a compression spring (16, 17) placed between two of their ends. One of the ends of each pliers is provided with a roller (18, 19) which, by interacting with a suitable opening device, counteracts the force of the compression springs (16, 17) thereby opening the jaws (9, 9' and 11, 11') of each pliers (1, 2).

6 Claims, 2 Drawing Sheets

BAG OPENING DEVICE FOR AUTOMATICALLY OPENING PLASTIC BAGS IN SUPERMARKET CHECK-OUT COUNTERS INCORPORATING BAG DISPENSING MACHINES

FIELD OF THE INVENTION

The present invention relates to supermarket check-out counters incorporating plastic bag dispensing machines and, more particularly, a device for automatically opening the bags before they are filled.

BACKGROUND OF THE INVENTION

It is known that frequently in supermarkets devices are placed for dispensing plastic bags, having the object of helping the operators and/or the customers in inserting into said bags the items purchased at the supermarket. There are also known bag opening devices which are incorporated in the supermarket check-out counters. Devices of this kind are described for example in the U.S. Pat. No. 4,085,822 and in U.K. Patent Appln. No. 2,055,084.

Moreover, it has been recently invented, and forms the object of the Italian Patent Appln. No. 2455 A/89 of the same Applicant, an integrated machine suitable to be incorporated in a supermarket checkout counter, which automatically dispenses the plastic bags one at a time from a continuous strip of bags, opens them underneath a suitable mouth located on the counter upper surface, and unloads them after they have been filled.

All the above mentioned prior art apparatus and machines comprise a device for opening the plastic bags one at a time, and for keeping them open as long as they are filled by the customer and/or the check-out counter operator. Such known devices, though very functional and reliable, are not without inconveniences, such as jamming, tearing of the bag edges, and so on.

It is therefore an object of the present invention to provide a device, free from these inconveniences for automatically opening the bags and keeping them firmly in an open position as they are being filled.

This object is attained by a device comprising two pliers capable of horizontal reciprocating motion on motor-driven guides which grasp and open the two opposite sides of a bag fed by conveyor belts. Each pliers consists of two jaws hinged at the guides and pushed against each other by a spring interposed between at their ends. One end of each pliers is provided with a roller suitable to interact with a device that opens and closes the pliers.

The bag opening device according to the present invention has the advantage of having a very simple structure, and therefore maximum reliability. Another advantage of the bag opening device according to the present invention is of an economic nature, since its simple structure requires reduced manufacturing costs.

BRIEF DESCRIPTION OF THE DRAWINGS

These and other advantages of the bag opening device according to the present invention will be evident from the following detailed description of one embodiment thereof, with reference to the attached drawings wherein.

DETAILED DESCRIPTION OF THE PRESENTLY PREFERRED EMBODIMENTS

Figure 1:
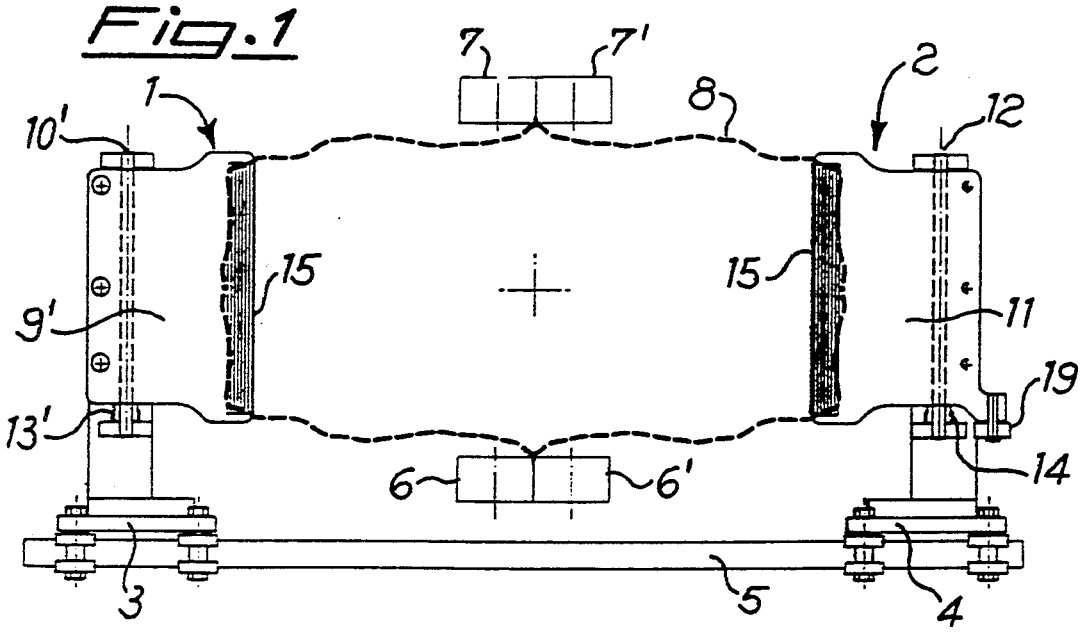
FIG. 1 shows a plan view of the bag opening device according to the present invention.

Referring to FIG. 1, it can be seen that the bag opening device according to the present invention essentially comprises the two pliers 1, 2, secured to guides 3, 4, respectively, and capable both of a horizontal reciprocating motion along rail 5 under the action of a motor reducer (not shown). The bag opening device is mounted on the automatic filling machines below the mouth through which are introduced the items to be inserted in the bags, as well as near the bag dispensing device. In FIG. 1 the pairs of bag feeding belts 6, 6' and 7, 7' of the bag dispensing device is shown. In the figure is shown by broken lines a bag 8 which, as it is still held at one side between the pair of feeding belts 6, 6' and between the pair of feeding belts 7, 7' at the other side, has been grasped and opened by pliers 1 and 2.

The to-and-fro movement of guides 3 and 4 along rail 5 is coordinated in such a way that they progressively and concurrently move towards or away from each other. The position of maximum mutual distance of guides 3 and 4 roughly corresponds to that illustrated in FIG. 1, namely that pliers 1 and 2, driven by the guides, completely open bag 8 that they grasped when they were in their position of maximum mutual approachment. The bag opening device is mounted near the bag feeding belts 6, 6' and 7, 7', in such a way that when pliers 1 and 2 are in their maximum approachment position, they contact bag 8 and can thus grasp and open it.

Pliers 1 consists of an upper jaw 9 (not visible in FIG. 1) and of a lower jaw 9' (not visible in FIG. 1) which are urged against each other by springs located between their ends near pins 10 (not visible in FIG. 1) and 10', by which jaws 9 and 9', respectively, are hinged at guide 3. Likewise, the opposite side pliers 2 consists of an upper jaw 11 hinged at guide 4 by means of pin 12, and of a lower jaw 11' (not visible) hinged at guide 4 by means of pin 12' (not visible). Jaws 11 and 11' of pliers 2 are also urged against each other by springs interposed between their ends near pins 12 and 12'.

Onto pins 10, 10', as well as 12, 12', are keyed pairs of toothed wheels 13, 13' and 14, 14', respectively, each being integral with one jaw 9, 9' and 11, 11'. The toothed wheels of each pair mesh with one another in such a way that the rotation of a wheel in one direction causes the rotation of the other wheel in the opposite direction. There is thus obtained the mutual spreading apart or approaching of jaws 9, 9' and 11, 11' integral with said toothed wheels, namely the opening or closing of pliers 1 and 2, respectively.

The upper jaws of each pliers have, on their outer end, a roller 18 or 19 which control the opening of pliers 1 and 2, as will be better described hereinafter. Both the upper and the lower jaws of both pliers have inner ends, namely those facing each other, which are coated with a rubberized material 15 which provides a firm grip of the pliers on the slippery plastic material comprising the bags 8 to be grasped and opened.

Figure 2:
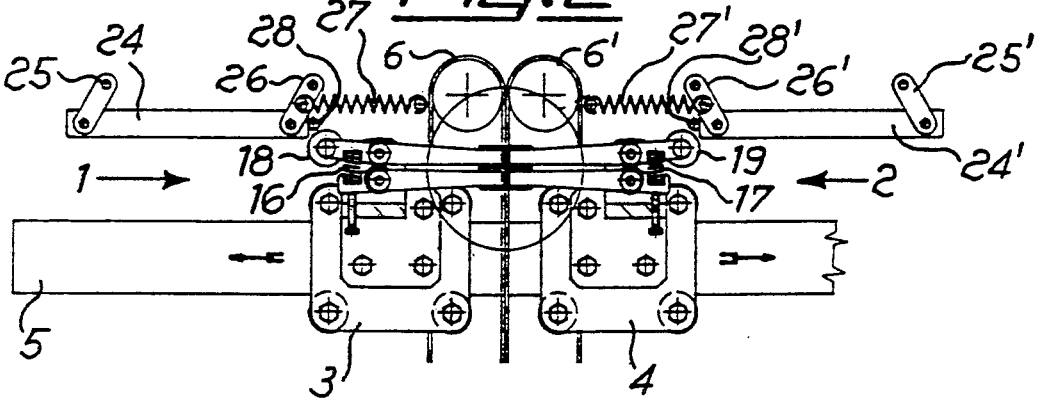
FIG. 2 shows a side elevational view of the same device.

Referring to FIG. 2, there can be seen guides 3 and 4 in the moment when, after reaching their maximum approachment position, are about to start moving mutually apart, as illustrated by the two arrows shown on rail 5. In the figure there can also be seen rollers 18 and 19 of the two pliers, as well as springs 6 and 17 which push against each other jaws 9, 9', Which form pliers 1, and jaws 11, 11', which form pliers 2, respectively. Each pliers has grasped between its rubberized ends 15 the bag 8, which had been conveyed to that point by the feeding belts 6, 6' and 7, 7'.

Figure 2A:
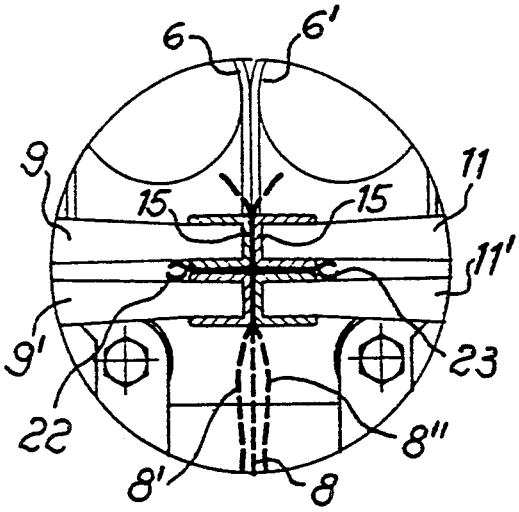
FIGS. 2A and 2B are two enlarged views of the area within the circle in FIG. 2, showing two successive chronological moments.

In FIG. 2A is shown, on an enlarged scale, the area enclosed within the circle in FIG. 2, wherein can be seen bag 8, which has been conveyed to that point by the conveyor belts 6, 7', as it is being held between jaws 9, 9' of pliers 1 and jaws 11, 11' of pliers 2. More precisely, bag 8 is vertically held between the facing rubberized ends 15 of pliers 1 and 2, while it is horizontally grasped between the facing rubberized facing ends of jaws 9, 9' of pliers 1 and of jaws 11, 11' of pliers 2, so that pliers 1 horizontally grasps the side 8' of bag 8 and pliers 2 horizontally grasps the side 8'' of the same bag.

Figure 2B:
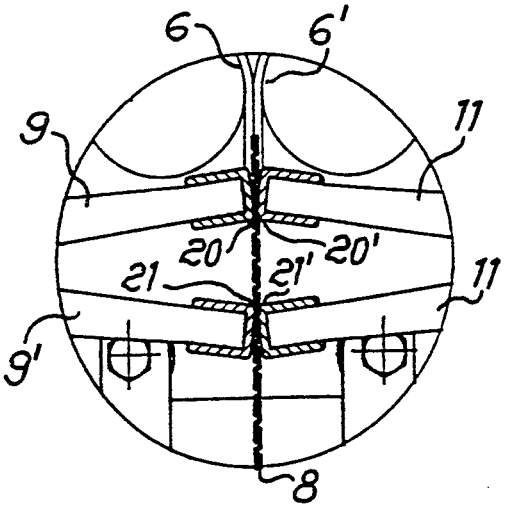

FIG. 2B shows the same part of the device illustrated in FIG. 2A, but in a previous operative step. In fact FIG. 2B shows the moment wherein jaws 9, 9' and 11, 11' of pliers 1 and 2 are closing, the latter having by that time entirely performed their mutual approachment motion. In such a position the front areas of the rubberized ends 15 of jaws 9 and 9' of pliers 1 have come in contact with one side of bag 8 at points 20 and 21, while at points 20' and 21' the rubberized front ends of jaws 11 and 11' of pliers 2 have come in contact with the opposite side of the bag. The friction exerted by the rubberized material on the slippery plastic of which bag 8 is made, causes jaws 9, 9' and 11, 11' to firmly grasp the sides of bag 8. The closing movement of such jaws, which makes point 20 approach point 21, and point 20' approach point 21', causes a loops 22 and 23 to appear on each side of bag 8 as shown in FIG. 2A, which are determinant to the purposes of the present invention. These loops are firmly grasped between pliers 1 and 2, respectively, which move apart together causing bag 8 to open.

In FIG. 2 is also shown the mechanism which, by cooperating with the above rollers 18 and 19, causes pliers 1 and 2 to open and close during their mutual approaching and departing movement. With respect to pliers 1, such a mechanism consists of a stop 24 with the ends pivoted at the connecting rods 25 and 26, which have in turn their other end rotatably fastened to the machine frame. The central part of the connecting rod 26 is fastened to one end of spring 27, the other end of which is fixed to the remaining body of the machine. The mechanism is completed by an abutment 28 which constrains the stroke of the stop rightwards, i.e. in the direction of mutual approachment of pliers 1 and 2. The analogous opening and closing device of pliers 2 comprises the movable stop 24' pivoted at the connecting rods 25' and 26', as well as the return spring 27' and the abutment 28'.

Figure 3:
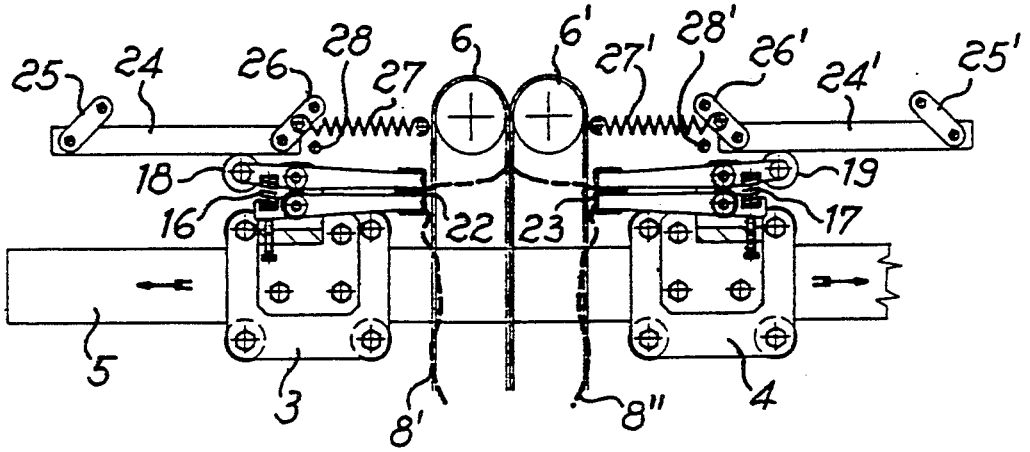
FIGS. 3, 4 and 5 show side elevational views of the device of FIG. 1 during the operative steps following the one shown in FIG. 2.

With reference to FIG. 3, it can be seen that when pliers 1 and 2 start moving mutually apart, roller 18 of pliers 1 freely runs towards the left, sliding under stop 24, which, at this point, does not perform its real stop function because it is lifted upwards due to the leftwards rotation of the connecting rods 25 and 26. Such a rotation also involves the drawing of stop 24 away from abutment 28, as well as the tensioning of the return spring 27. Likewise, the rightwards shifting of pliers 2 occurs as roller 19 freely runs under stop 24' which lifts up slightly and shifts towards the right, drawing away from abutment 28' and causing the tensioning of the return spring 27'.

In FIG. 3 it can also be seen how pliers 1 and 2, as they depart from each other under the action of guides 3 and 4 which run along rail 5 in the direction indicated by the arrow, cause the mutual setting apart of loops 22 and 23 firmly grasped between said pliers, and therefore the separation of the side 8' from the side 8'' of the bag, which is thus opened.

Figure 4:
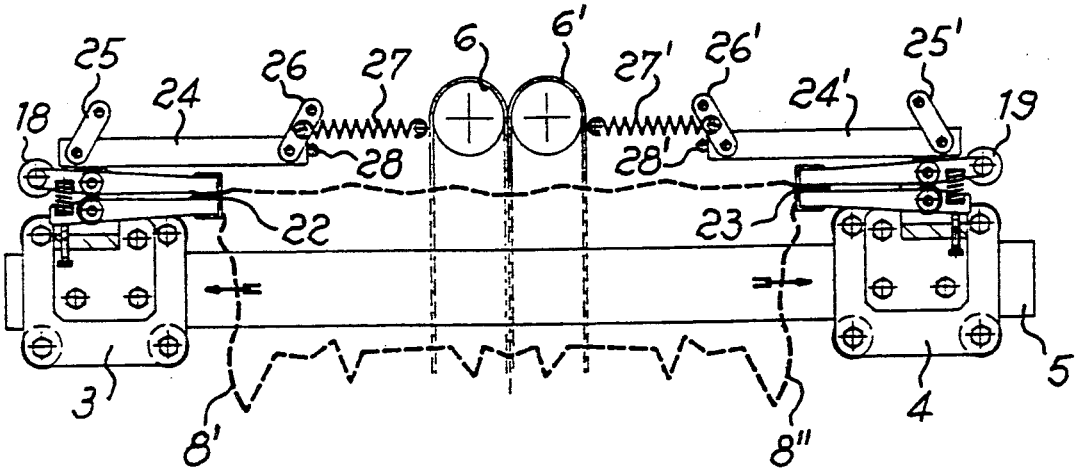

FIG. 4 shows the moment where pliers 1 and 2 reach their position of maximum mutual distance, with consequent complete opening of the bag 8, whose loops 22 and 23 they firmly grasp. At this stage, roller 18 of pliers 1 has gone past stop 24 which, under the action of the return spring 27, is restored to its initial position, leaning against abutment 28. Likewise, the roller 19 disengaging from stop 24' makes the latter return to its initial position against abutment 28' under the action of the return spring 27'. The maximum opening of bag 8 also involves the disengagement thereof from the conveyor belts; as it can be seen in the figure, in fact, the bag is no longer held between belts 6 and 6', unlike in the positions illustrated in FIGS. 1 and 3.

Once bag 8 has been fully opened, it can be filled with the items purchased at the supermarket until all the available room in the bag has been completely occupied, or until there are no more items to insert into the bag. Once it has been filled, bag 8 should be ejected from the machine after it has been released by pliers 1 and 2 in the way described hereinafter.

Figure 5:
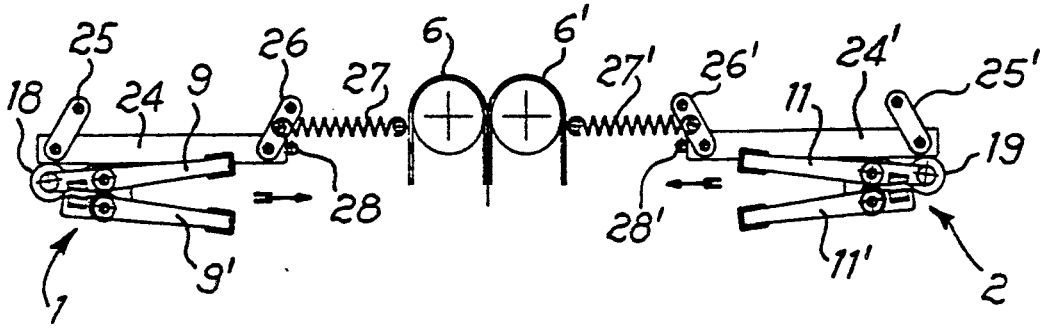

FIG. 5 shows the opening of pliers 1 and 2, which occurs during their mutual approachment motion. When pliers 1 is returned to the right by guide 3, roller 18 hits against stop 24 which this time does not shift to let said roller slide, being stopped by abutment 28. Roller 18 is therefore compelled to avoid stop 24 by passing under it. The lowering of roller 18 fastened to one end of jaw 9 of pliers 1 involves the raising of the opposite end of that jaw, together with the rotation of the toothed wheel 13 integral with said jaw, as well as of the toothed wheel 13' in mesh with the toothed wheel 13. Such a rotation involves the spreading apart of jaws 9 and 9' of pliers 1, and therefore the opening of the latter and the release of bag 8. At the opposite side, roller 19 is likewise forced to lower in order to slide under stop 24'. This lowering causes the spreading apart of jaws 11 and 11', and therefore the opening of pliers 2 with the consequent release of bag 8 at that side too. Since it is no longer held by pliers 1 and 2, nor by the conveyor belts 6, 6' and 7, 7', base 8 is completely released and can therefore be taken away or conveyed to the eject exit of the machine.

After releasing the already filled bag 8, pliers 1 and 2 go on in their mutual approachment motion, and remain open as long as rollers 18 and 19 slide under the stops 24 and 24', respectively. When said rollers have gone past the ends of the relevant stops, they no longer counteract the force of springs 16 and 17 which push again jaws 9, 9' of pliers 1 and jaws 11, 11' of pliers 2 against each other. During such closing motion of pliers 1 and 2, they firmly grasp on the sides of bag 8, as illustrated in FIG. 2B, and grasp the loops 22 and 23 that are thus formed, as illustrated in FIG. 2A. The device has thus returned to the position shown in FIG. 2 to start a new operative cycle, as above described.

What is claimed is:

1. A device for opening a plastic bag in a supermarket check-out counter incorporating a plastic bag dispensing machine comprising:

a frame;

two guides (3, 4) slidably mounted on said frame so that said guides are capable of a reciprocal horizontal motion within said frame;

two pliers (1, 2) mounted on said two guides and positioned to grasp and pull apart two opposite sides of the bag fed by the plastic bag dispensing machine, each of said pliers comprising:

a pair of jaws (9, 9' and 11, 11'), said jaws having a bag grabbing end and a spring end;

a pair of toothed wheels (13, 13' and 14, 14') that mesh with each other and onto each one of which is securely mounted one jaw of said pair of jaws;

a compression spring (16, 17) positioned between said spring ends of said jaws to urge said grabbing end of said jaws together with a compression force; and a roller (18, 19) rotatably mounted to said spring end of one said jaws; and an opening mechanism which engages said rollers of said pliers to counteract the compression force applied by said compression springs (16, 17) and thereby to open the jaws (9, 9' and 11, 11') of each pliers (1, 2).

2. Device according to claim 1, wherein said opening mechanism for each pliers (1, 2) comprises:

an abutment (28, 28');

two connecting rods (25, 26 and 25', 26');

a movable stop (24, 24') positioned proximate to the bag dispensing machine and pivoted on said connecting rods (25, 26 and 25', 26'); and a return spring (27, 27') which urges said movable stop against said abutment;

wherein said movable stop contacts said rollers (18, 19) of said pliers (1, 2) so as to allow said rollers to freely slide as said pliers draw apart from each other and remain closed, and so as to cause said rollers to shift vertically as said pliers approach each other thereby causing said pliers to open.

3. Device according to claim 1, characterized in that said bag grabbing ends of said jaws (9, 9' and 11, 11') have a rubberized coating (15).

4. Device according to claim 2, characterized in that said bag grabbing ends of said jaws (9, 9' and 11, 11') have a rubberized coating (15).

5. Device according to claims 1, 2, 4 or 3, further comprising pins (10, 10' and 12, 12') mounted to said guides (3, 4), said jaws being pivotally mounted on said pins, wherein said compression springs (16, 17) are positioned near said pins (10, 10' and 12, 12').

6. Device according to claim 5, characterized in that said toothed wheels (13, 13' and 14, 14') are integral with said jaws (9, 9' and 11, 11') and are mounted upon said pins (10, 10' and 12, 12').

* * * * *